US005226399A

United States Patent [19]

Ozawa

[11] Patent Number: 5,226,399

[45] Date of Patent: Jul. 13, 1993

[54] COMPONENT LAYOUT FOR TWO CYCLE ENGINE

[75] Inventor: Toshikazu Ozawa, Iwata, Japan

[73] Assignee: Yamaha Hatsudoki Kabushiki Kaisha, Iwata, Japan

[21] Appl. No.: 805,315

[22] Filed: Dec. 10, 1991

[30] Foreign Application Priority Data

Dec. 26, 1990 [JP] Japan ..... 2-406963
Jan. 11, 1991 [JP] Japan ..... 3-2140

[51] Int. Cl.[5] ..... F02M 67/02; F02B 39/04; F02B 33/04

[52] U.S. Cl. ..... 123/533; 123/65 BA; 123/198 C; 123/73 C; 123/41.44

[58] Field of Search ..... 123/65 BA, 73 A, 73 C, 123/73 V, 198 C, 533, 41.44

[56] References Cited

U.S. PATENT DOCUMENTS

| | | | |
|---|---|---|---|
| 1,366,445 | 1/1921 | Charter | 123/533 |
| 4,149,497 | 4/1979 | Zeliszkewycz | 123/533 |
| 5,022,355 | 6/1991 | Billingsley et al. | 123/73 A |
| 5,041,034 | 8/1991 | Sakamoto | 123/533 |
| 5,094,217 | 3/1992 | Kaku et al. | 123/533 |
| 5,136,990 | 8/1992 | Motoyama et al. | 123/73 A |

*Primary Examiner*—Willis R. Wolfe
*Attorney, Agent, or Firm*—Ernest A. Beutler

[57] ABSTRACT

Two embodiments of crankcase compression, internal combustion engines have air/fuel injection systems that include an air compressor driven by the engine and protected by the intake manifold. In one embodiment, the air compressor also drives a water pump and in both embodiments the induction system is designed so as to maintain substantially equal length runners for the individual crankcase chambers. This is accomplished by forming the check valves the communicate the runners with the crankcase chambers in parallel relationship to the respective runners.

46 Claims, 12 Drawing Sheets

COMPONENT LAYOUT FOR TWO CYCLE ENGINE

BACKGROUND OF THE INVENTION

This invention relates to a component layout for a two cycle engine and more particularly to an improved compact component and induction system for a two cycle internal combustion engine.

Two cycle engines are receiving considerable attention due to their possible application for automotive use. An important advantage of a two cycle engine, particularly for automotive use, is the relatively compact nature of such engines. However, in order to improve the efficiency and exhaust emission control of such engines, it has been proposed to employ a direct fuel injection system for such engines. In some applications, air/fuel injectors are being considered.

As is well know, a two cycle, crankcase compression engine inducts its air charge into the crankcase chambers of the engine where the charge is compressed and then transferred to the combustion chambers. This means that the induction system for a two cycle engine, unlike that of a conventional four cycle engine, is disposed at the lower portion of the engine rather than the upper portion of the engine. When such engines are employed for motor vehicles, certain auxiliaries must be driven off the engine. This is particularly true where the engine is provided with an air/fuel injector inasmuch as it is the practice to drive an air compressor for the air injection portion of the fuel/air injector from the engine. In conjunction with two cycle engines, this can present certain problems in respect to the placement and driving of the various accessories and auxiliaries driven by the engine.

It is, therefore, a principal object to this invention to provide an improved component layout for a two cycle engine.

It is further object to this invention to provide an improved component layout and drive arrangement for a two cycle engine that permits the engine to be employed in conjunction with an automotive type application.

As has been noted, the use of air/fuel injectors for two cycle engines requires the supply of compressed air for the air/fuel injectors. Of course, the air supplied to the air/fuel injectors should be filtered and this necessitate the use of an air filter element and induction system for supplying air to the air compressor. However, in order to improve the efficiency of the air compressor and to permit a small size, it is desirable to reduce the length of the intake system for the air compressor and also to position the air filter close to the air compressor. Of course, the main induction system for the engine also requires an air filter and certain advantages can be employed if the same air filter is employed for filtering both the induction system air and the air supplied to the air compressor. Of course, this gives rise to obvious problems in connection with component layout.

It is, therefore, a further object to this invention to provide an improved air induction system for the intake and air compressor of a two cycle, crankcase compression engine.

It is a further object to this invention to provide an air intake system for an air compressor of an engine and the engine induction system wherein a single air filter element filters the air to both the devices while still maintaining a compact construction and short runner lengths.

As has already been noted, one disadvantage in the use of two cycle engines in automotive applications is the fact that the induction system for the engine is positioned at the lower portion of the engine rather than the upper portion as with a more conventional four stroke engine. Furthermore, the induction system for two cycle engines normally employs reed type check valves at the juncture of the intake manifold with a crankcase chambers of the engine to preclude loss of compression back through the induction system. Furthermore, it is desirable if the induction system has a common portion to provide for a single air filter element for all chambers and also so as to permit the use of a single throttle valve. When the manifold has plural outlets, reed type check valves and a single inlet, however, it is necessary to insure that all of the runners of the manifold have substantially the same length.

It is, therefore, a still further object to this invention to provide an improved induction system for a two cycle, crankcase compression, internal combustion engine having multiple cylinders and embodying a manifold with a single air inlet and runners that have substantially the same length.

SUMMARY OF THE INVENTION

A first feature of this invention is adapted to be embodied in a crankcase compression, two cycle, internal combustion engine that comprises a crankcase forming at least in part one crankcase chamber, an intake manifold affixed to said crankcase and supplying a charge to the crankcase chamber and an air compressor driven by the engine for supplying compressed air to the engine other than through the intake manifold and crankcase chamber. In accordance with this feature of the invention, the air compressor is juxtaposed to the intake manifold.

Another feature of the invention is adapted to be embodied in a crankcase compression, two cycle engine, internal combustion engine having an air/fuel injection system. The engine includes a crankcase forming at least one crankcase chamber and an intake manifold that is affixed to the crankcase chamber and which supplies an air charge to the crankcase chamber. An air compressor is driven by the engine for supplying compressed air to the air/fuel injector and the air compressor is juxtaposed to the intake manifold.

Another feature of the invention is adapted to be embodied in an internal combustion engine that comprises an air induction system for supplying air to the engine for its combustion system. The induction system includes a filter element having an upstream side and a downstream side through which all air flowing to the engine must pass. An air compressor is provided for supplying air to the engine for its operation. Means are provided for supplying only a portion of the air flowing through the air filter element to the air compressor from the induction system downstream of the air filter element.

Yet another feature of the invention is adapted to be embodied in a crankcase compression, internal combustion engine having a crankcase divided into at least two laterally spaced chambers. An intake manifold has a pair of angularly disposed runners extending from a common inlet to outlets each communicating with a respective one of the crankcase chambers. A reed type check valve is positioned within each of the outlets for permitting flow into the crankcase chambers from the runners and for precluding reverse flow from the crankcase chambers into the intake manifold. The check valves are disposed substantially parallel to the respective runners for maintaining substantially equal length passages from the inlet openings of the manifold to its outlets.

DETAILED DESCRIPTION OF THE PREFERRED EMBODIMENTS OF THE INVENTION

Figure 1:
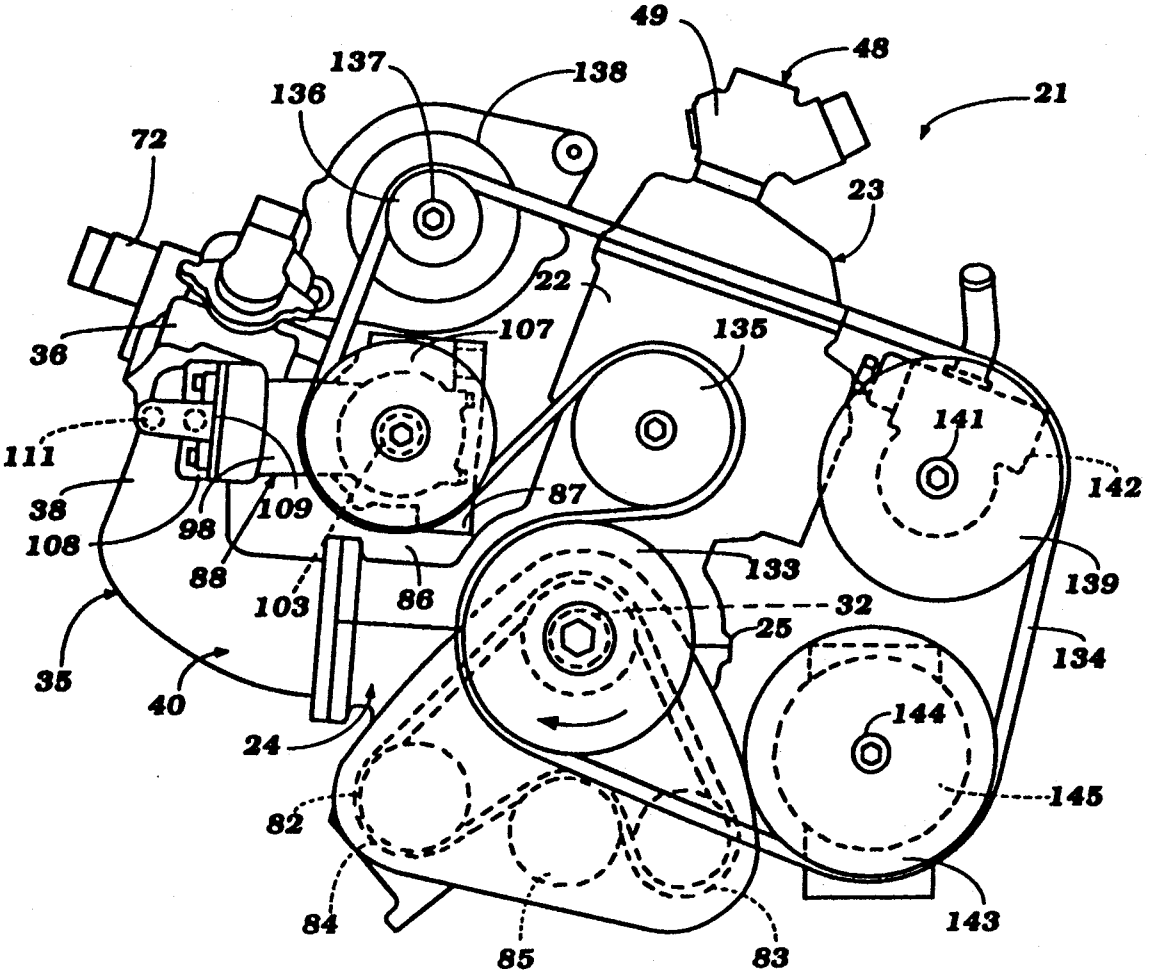
FIG. 1 is a front elevational view of an internal combustion engine operating on a two stroke, crankcase compression principal and adapted to form a power plant for a motor vehicle and constructed with an embodiment of the invention.

Referring first to the embodiment of FIGS. 1 through 7, a three cylinder, inline, crankcase compression, internal combustion engine constructed in accordance with this embodiment of the invention is identified generally by the reference numeral 21. Although the invention is described in conjunction with a three cylinder inline engine, it should be readily apparent to those skilled in the art that certain facets of the invention can be employed in conjunction with engines having other numbers of cylinders and other cylinder configuration. Also, although the invention is described in conjunction with a two cycle, crankcase compression engine, some features of the invention may find utility in engines operating on other cycles. However, the invention has particular utility in two cycle, crankcase compression engines and particularly those intended for use in automotive applications.

The engine 21 includes a cylinder block assembly 22 which, as has been noted, has an inline configuration in the illustrated embodiment. In this embodiment, the cylinder block 22 is disposed so that it is inclined from the vertical in a rearward direction as shown in FIG. 1. This orientation is particularly advantageous when employed in conjunction with a front engine motor vehicle wherein the cylinder block 22 will be inclined slightly rearwardly toward the passenger compartment.

A cylinder head assembly 23 is affixed in a suitable manner to the cylinder block 22 at its upper end and a crankcase member, indicated generally by the reference numeral 24 is affixed to a skirt portion 25 at the lower end of the cylinder block 22.

Figure 2:
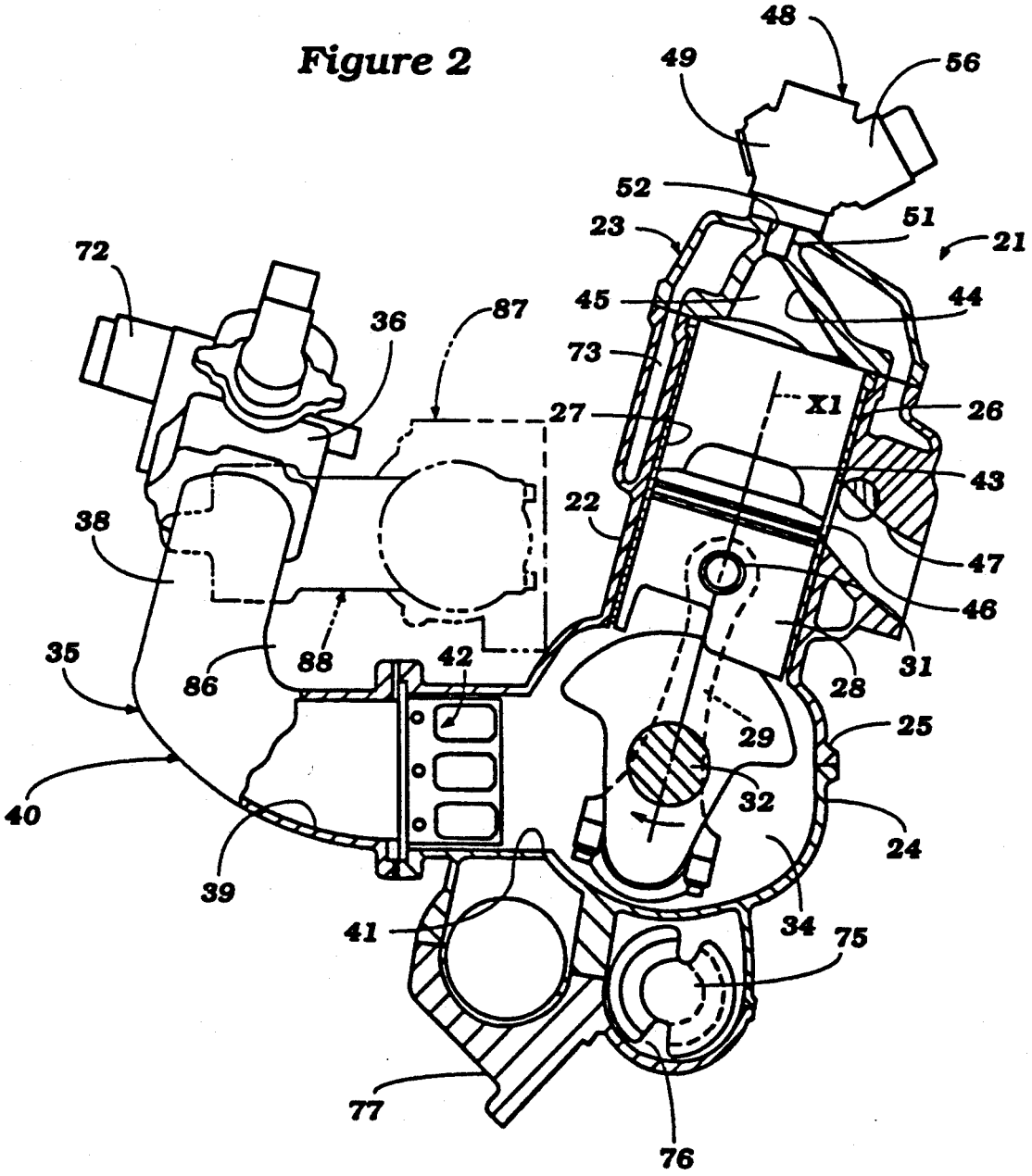
FIG. 2 is a cross sectional view taken through a single cylinder of the engine, with certain portions shown in phantom, so as to understand the orientation of the components.

Referring now in detail primarily to FIG. 2, the cylinder block 23 is formed from a light alloy material such as aluminum and is provided with pressed or cast-in cylinder liners 26 which define cylinder bores 27. The cylinder bores 27 all have their axes lying in a common plane $X_1$ which is, as has been noted, inclined to the vertical in a rearward direction when viewing the engine compartment transversely.

Pistons 28 reciprocate in each of the cylinder bores 27 and are connected to the upper ends of connecting rods 29 by piston pins 31. The lower ends of the connecting rods 29 are journalled on respective throws of a crankshaft 32 which is journalled for rotation in the crankcase formed by the cylinder block skirt portion 25 and the crankcase chamber 24 for rotation about an axis that lies in the plane $X_1$ and which extends transversely across the engine compartment. The crankshaft 32 has bearing portions that are journalled within webs 33 of the cylinder block 22 and crankcase member 24. In addition to the bearings, there are provided seals so that the crankcase chamber is divided into individual chambers 34 each of which is sealed from the others, as is well known in two cycle engine practice.

Figure 7:
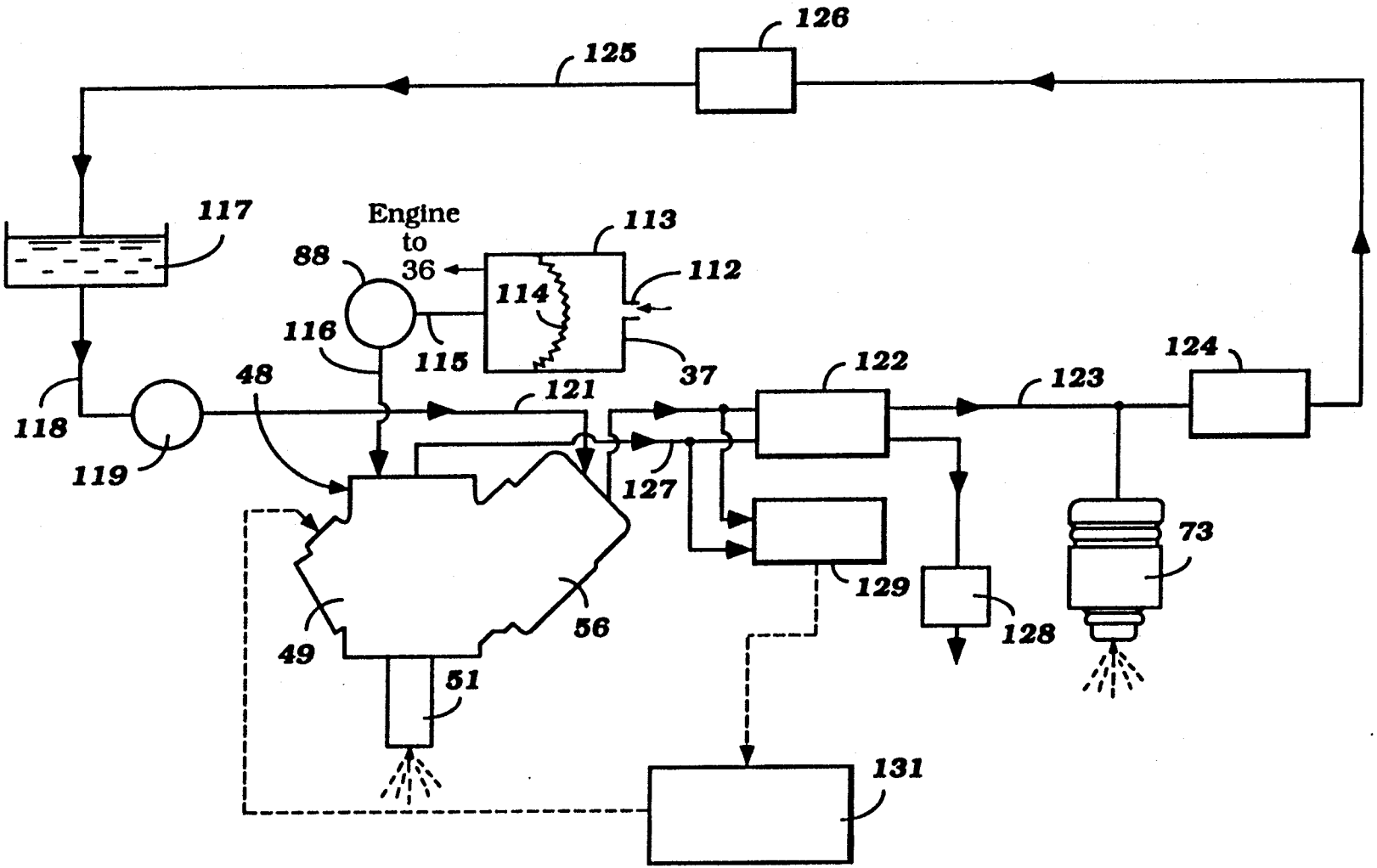
FIG. 7 is a partially schematic view showing the fuel and air systems for the engine.
Figure 8:
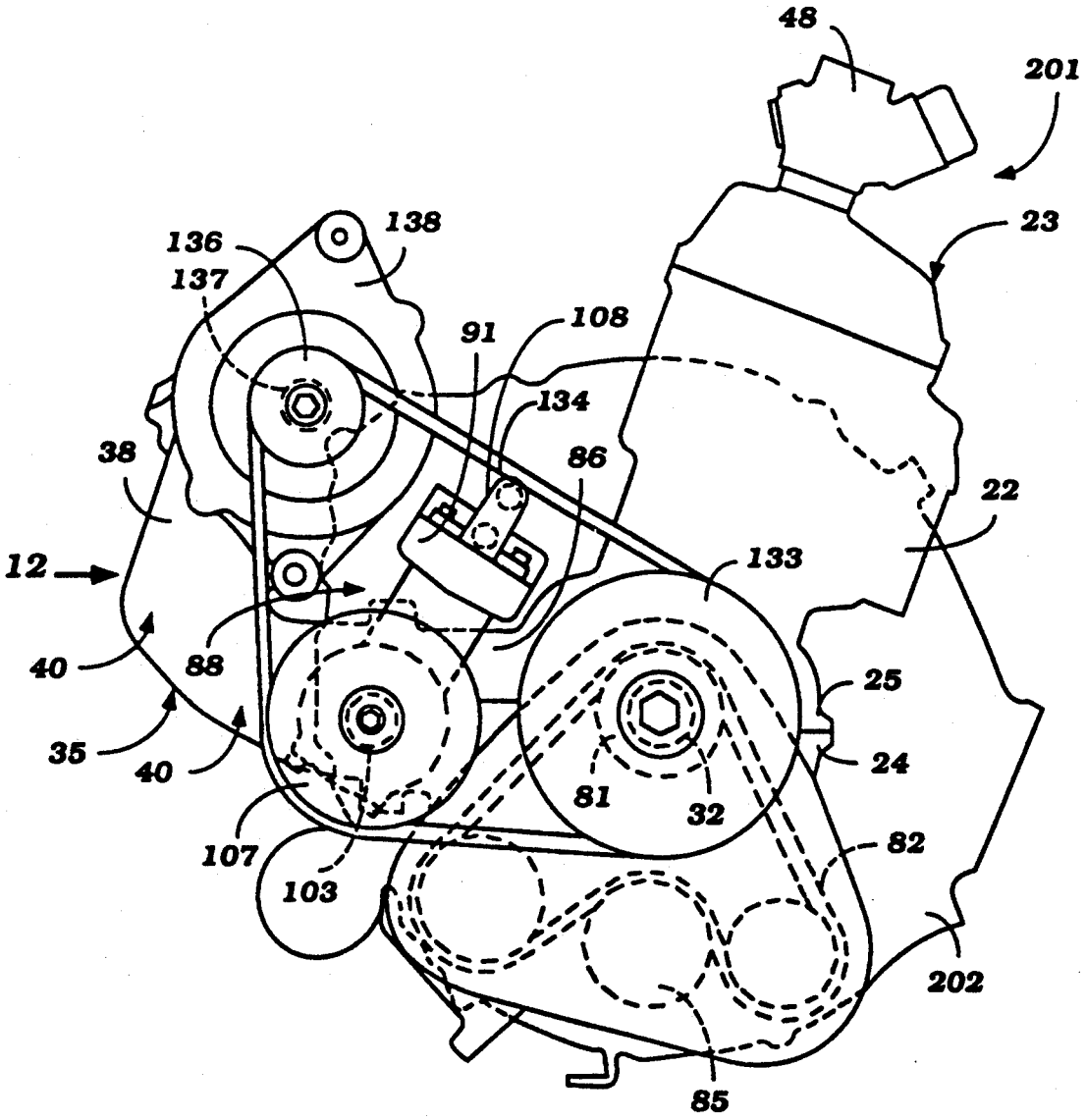
FIG. 8 is a front elevational view, in part similar to FIG. 1, and shows another embodiment of the invention.

An intake charge is delivered to each of the crankcase chambers 34 from an induction system, indicated generally by the reference numeral 35. This induction system 35 includes a throttle body 36 in which a flow controlling throttle valve (not shown) is received. An air cleaner embodying a filter element, which is not shown in FIGS. 1 through 6 but which is depicted schematically at 37 in FIG. 7, is provided for filtering an atmospheric air charge before delivery to the throttle body 36. The downstream end of the throttle body 36 communicates with a common inlet portion 38 of a manifold, indicated generally by the reference numeral 40 and which has individual runners 39, to be described, which communicate with intake ports 41 formed in the side of the crankcase member 34 and in which reed type check valves 42 are positioned. The reed type check valves 42 permit the flow of an intake charge into the intake ports 41 during upward movement of the pistons 28 but preclude reverse flow when the pistons 28 are moving downwardly to compress the charge in the crankcase chambers 34.

The charge which has been compressed in the crankcase chambers 34 is then transferred to the area above the pistons 28 through a plurality of scavenge passages 43 that are formed in the cylinder block 22 and cylinder liners 26. The area above the head of the piston 28, cylinder bore 27 and a recess 44 of the cylinder head 23 forms an individual combustion chamber 45 for each cylinder bore 27. A spark plug, not shown, if the engine is a spark ignited engine, is provided in the cylinder head 25 for firing the charge in the combustion chamber 45. Of course, the invention can also be employed in conjunction with diesel engines and in such instances no spark plug will be provided but there may be provided a glow plug for assisting in cold starting and cold running.

The burnt charge then exists through an exhaust port 46 formed in the cylinder liner 26 and to an exhaust passage 47 formed in the side of the cylinder block 22 for discharge to the atmosphere through a suitable exhaust manifold and exhaust system (not shown).

The fuel is supplied to the combustion chamber 45 by an air/fuel injector 48 that is mounted within the cylinder head 45 in a manner to be described. The construction of the air/fuel injector 48 may be best understood by reference to FIG. 6 and will now be described in conjunction with that figure. The air/fuel injector 48 includes an outer housing assembly 49 made up of a plurality of pieces including a lower piece having a nozzle portion 51 that extends into a bore 52 formed in the cylinder head 23. The nozzle piece 51 in turn, is provided with an internal bore 53 in which an insert piece 54 is positioned. The insert piece 54 and bore 53 define a first or fuel chamber 55 to which fuel is supplied from a fuel injector 56 which is mounted in a upper piece of the housing assembly 49. The fuel injector 56 has a discharge nozzle 57 that sprays into a porting arrangement 58 formed in the housing 46 and which communicates with the chamber 55.

The lower end of the chamber 55 communicates with a plurality of fuel passages 59 formed in an enlargement of the insert piece 54 and which terminate in a valve seat surface 61 formed therein. An injector valve 62 has a head portion 63 which opens and closes the valve seat 61 and, accordingly, the passages 59. The injector valve 62 has its stem portion 64 extending upwardly through a bore formed in the insert piece 54 and is connected to an armature 66 at the upper end of the housing assembly.

The valve stem 64 has a plurality of enlarged protrusions 67 that form a guide for the reciprocation of the injector valve 62 while, at the same time, permitting the flow of compressed air therepast. The compressed air is delivered to the bore 65 through an inlet port 67.

The injector valve 62 is held in its closed position by a coil compression spring 68 that acts against the armature 65. A solenoid 69 having a winding 71 is energized so as to draw the armature 66 downwardly to compress the spring 68 and open the injector valve 62. At this time, compressed air and fuel will be delivered to the combustion chamber. The strategy of timing of the injection of the fuel by the fuel injector 56 and the opening of the injector valve 62 may be of any known type such as a pre-charge type or a type in which the fuel is supplied only when the injector valve 62 is opened.

A sub-fuel injector 72 may also be supplied for providing additional fuel to the engine, particularly under high speed, high load conditions. The sub-injector 72 is mounted in the throttle body 36. The sub-injector 72 may be a pure fuel injector or may, like the injector 48, be an air/fuel injector.

The engine 21 is liquid cooled and to this end there is provided a cooling jacket 73 formed in the cylinder block 22 and cylinder head 23. Liquid coolant is circulated through the cooling jacket 73 by a coolant pump, to be described.

The engine 21 has thus far described may be considered to be conventional and, for that reason, components which are conventional will not be described any further inasmuch as their construction and operation will be well known to those skilled in the art.

Figure 3:
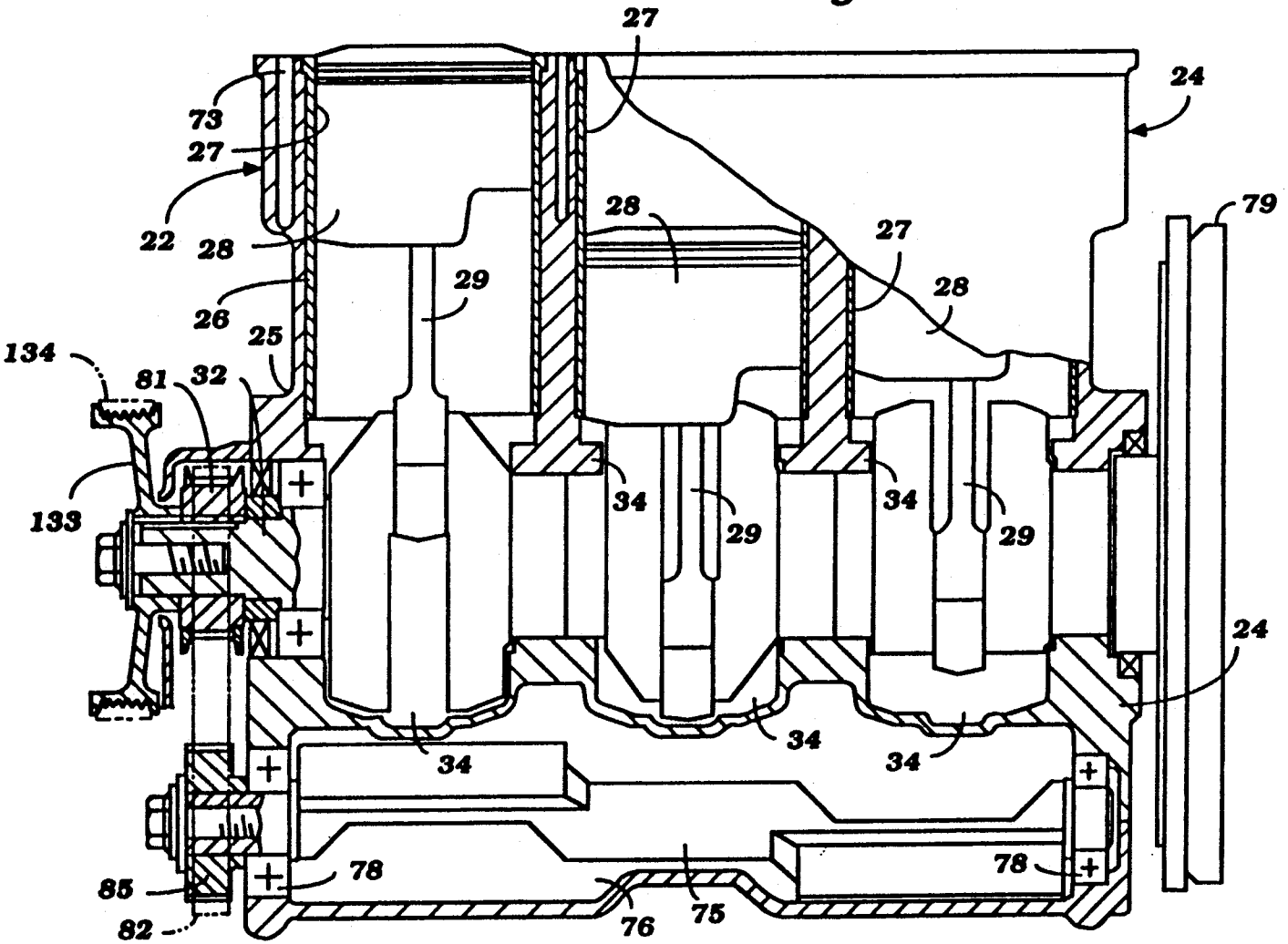
FIG. 3 is an enlarged cross sectional view taken along a longitudinal axis of the engine and shows primarily the crankcase chambers and the balance shaft therefore.

A balancer shaft, indicated generally by the reference numeral 75 and shown in most detail in FIGS. 1 through 3, is rotatably journalled within a balancer shaft chamber 76 formed beneath the crankcase chambers 34 and within the crankcase member 24 and a cover member 77 which is affixed thereto. The balancer shaft 75 is rotatably journalled in a pair of spaced apart bearings 78 and rotates about an axis that is parallel to the axis of the crankshaft 32 and at the same speed. Because of the fact that the engine 21 is a two cycle, crankcase compression, it is possible to put the balancer shaft 71 substantially beneath the crankshaft 32 without adding significantly to the height of the engine. This is because the engine does not require a crankcase that holds a volume of lubricant for its lubrication, as is true with conventional automotive engines that operate on the four stroke cycle.

As may be seen in FIG. 3, a flywheel 79 is affixed for rotation with one end of the crankshaft 32 and has a relatively large outer diameter. The balancer shaft 75 is disposed radially inwardly from the periphery of the flywheel 79 and, accordingly, the engine has no greater height than a conventional four stroke engine would without such a balancer shaft. This positioning of the balancer shaft 75 also permits better balancing of the engine.

The balancer shaft 75 is driven from the crankshaft 32 so as to rotate at crankshaft speed but in an opposite direction. This drive includes a driving sprocket 81 that is affixed to the end of the crankshaft 32 opposite to the flywheel 79 and which drives a drive belt 82. The drive belt 82 is entrained over an idler sprocket 83 and a tensioner sprocket 84 that are positioned on opposite sides of the balancer shaft 75 and also below the crankshaft 32. A driving sprocket 85 is affixed for rotation with the forward end of the balancer shaft 75 and is engaged by the belt 85 for its drive.

Figure 4:
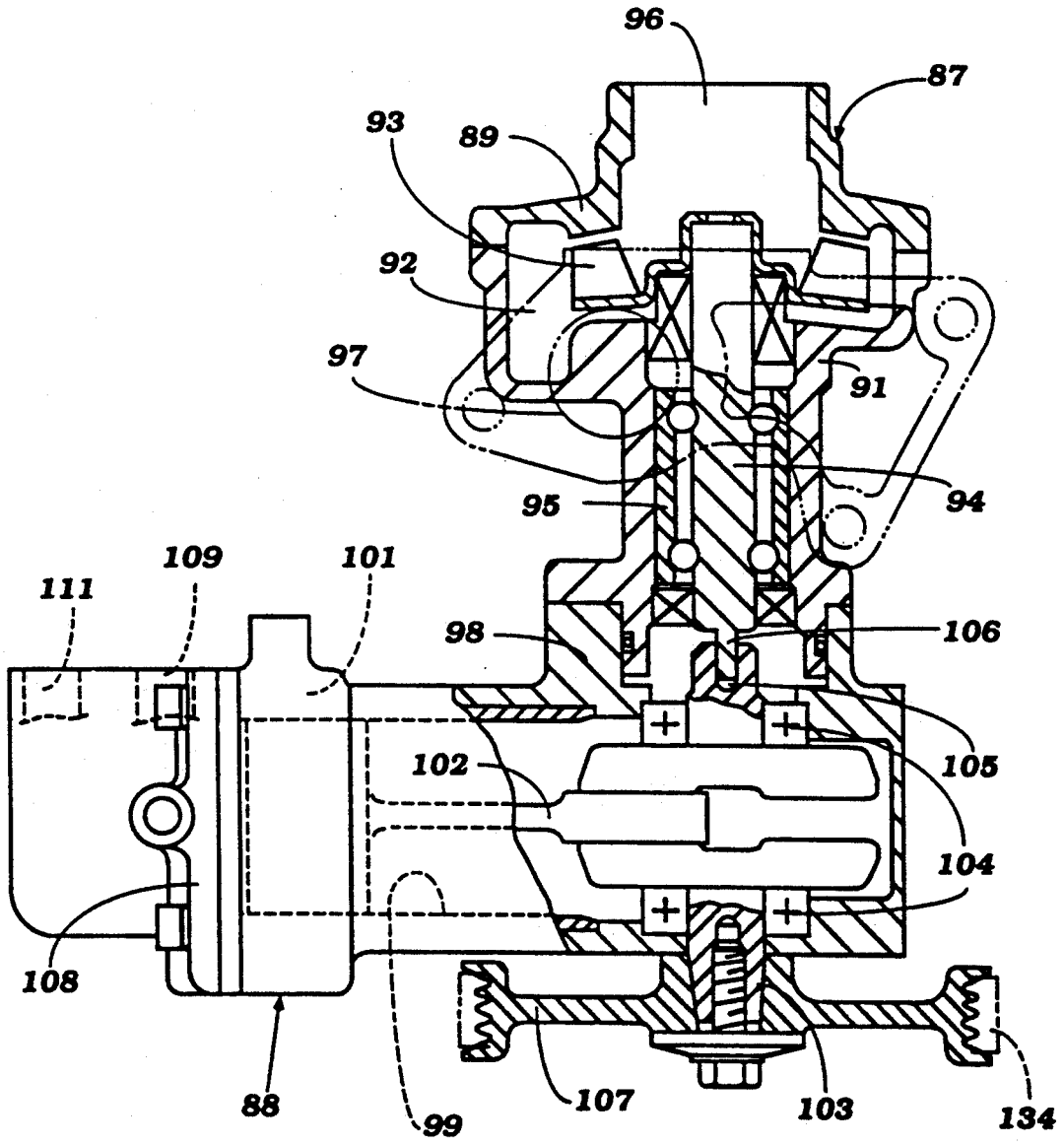
FIG. 4 is an enlarged top plan view, with portions broken away, showing the drive for the air compressor of the fuel/air injection system of the engine and the water pump for the engine.
Figure 5:
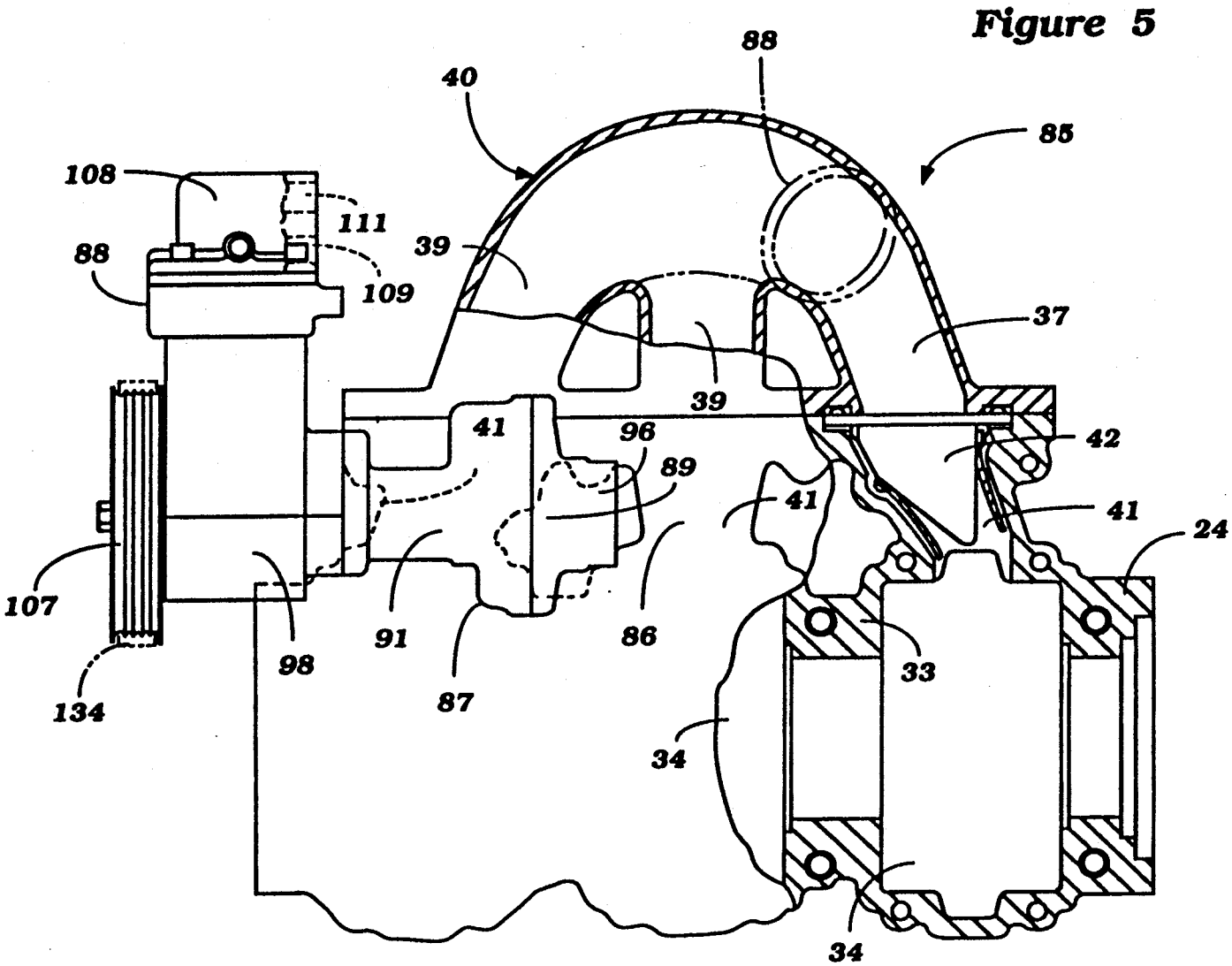
FIG. 5 is a partial top plan view, with portions broken away, showing the induction system and its relationship to the fuel/air injector, air compressor and water pump.
Figure 6:
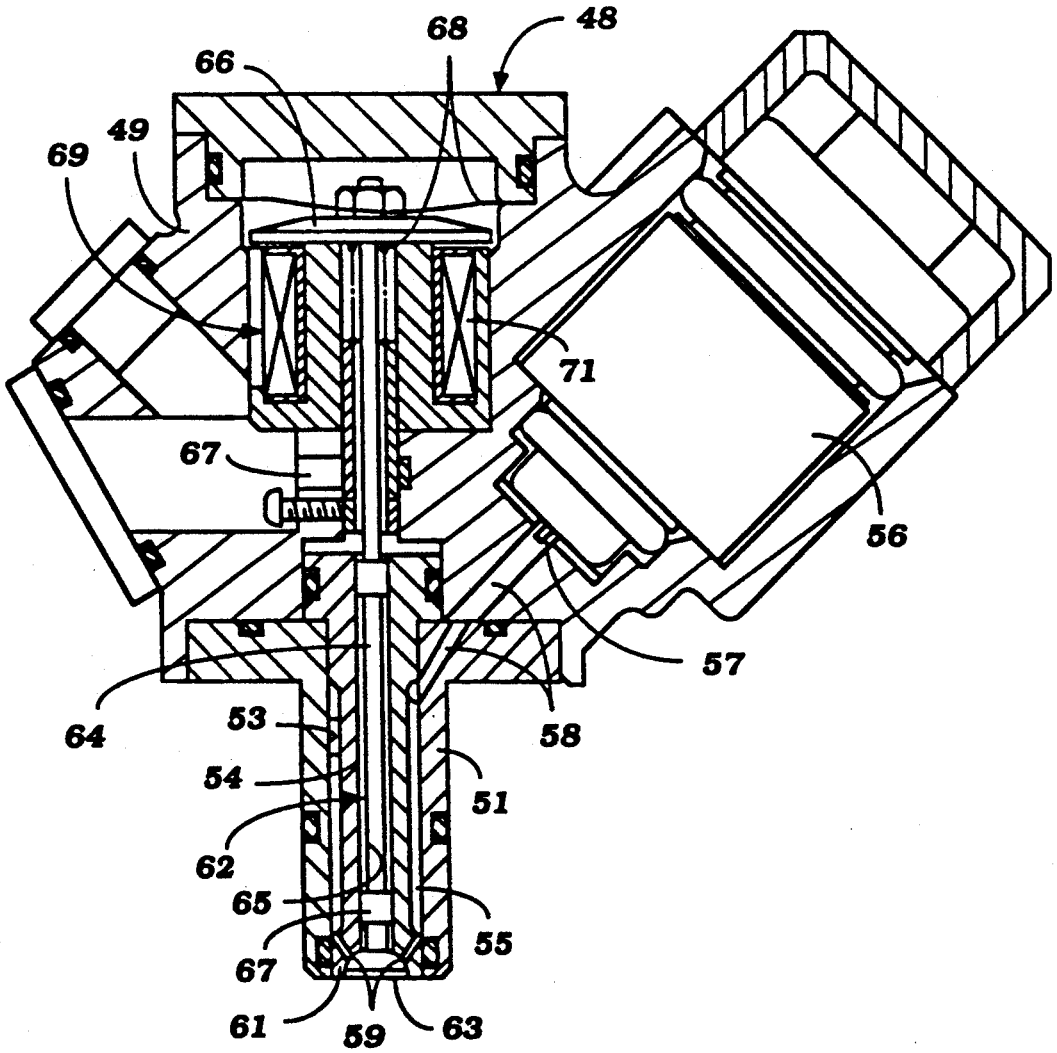
FIG. 6 is an enlarged cross sectional view taken through one of the fuel/air injectors of the engine.

As should be readily apparent, the positioning of the intake ports 41 in the lower portion of the crankcase chambers 34 results in the fact that the induction system 35 is positioned quite low relative to the overall engine as opposed to the high intake system employed with four cycle engines. The runners 39 extend generally horizontally forwardly of the intake ports 41 in the engine compartment and then merge at a common section which is supplied with air from the intake opening 38 and throttle body 36. The intake opening 38 also is inclined rearwardly away from the plane of FIG. 2 and this provides a generally opened space 86 forwardly of the engine and specifically the cylinder block 22 that can accommodate accessories or auxiliaries driven by the engine. These auxiliaries include a combined water pump for the circulating coolant through the cooling jacket 73 of the engine 21 and an air compressor for delivering air to the air/fuel injectors 48. This construction is best shown in FIG. 4 wherein the water pump is indicated generally by the reference numeral 87 and the air compressor is indicated generally by the reference numeral 88.

The water pump 87 is of the centrifugal type and includes a cover member 89 that is affixed to a base member 91 and which defines a pumping cavity 92. An impeller 93 is positioned in the pumping cavity 92 and is affixed, in a suitable manner, to a water pump drive shaft 94. The shaft 94 is journalled for rotation within the housing portion 91 by a bearing assembly 95.

Coolant is drawn into the water pump chamber 92 through an inlet opening 96 which communicates with a heat exchanger (not shown) and is discharged from the pumping cavity 92 through a discharge opening 97 that is connected by a conduit (not shown) to the cooling jacket 73 of the engine 21.

The air compressor 88 is of the reciprocating type and includes a cylinder block 98 that is connected to the water pump housing member 91 in a suitable manner. The cylinder block 98 defines a cylinder bore 99 in which a piston 101 is supported for reciprocation. The piston 101 is connected to a connecting rod 102 which is, in turn, journalled on a crankshaft 103 that is journalled within the cylinder block 98 by means of a pair of spaced apart bearings 104.

The crankshaft 103 has a slotted end 105 that receives a keyed end 106 of the water pump drive shaft 94 so as to rotatably couple these shafts together. A pulley 107 is affixed to the crankshaft 103 at its forward end and is driven from the engine crankshaft 32 in a manner to be described.

A cylinder head 108 is affixed to the cylinder block 98 in a known manner and has an inlet port 109 and an outlet port 111 in which check valves (not shown) are provided so as to permit air to be drawn into the cylinder bore 99 through the inlet port 109 and discharged from the outlet port to the air/fuel injectors 48.

It should be noted that the air compressor 88 is positioned so that the cylinder bore 99 extends generally horizontally and the cylinder head 108 is positioned immediately forwardly of the common inlet portion 38 of the intake manifold 40. Because of this close proximity, it is possible to deliver air to the inlet port 109 directly from the induction system downstream of the aforementioned air filter 37 as may be best seen in the schematic view of FIG. 7.

Referring specifically to FIG. 7, this illustrates schematically the fuel and air supplies for the main fuel/air injector 48 and the sub-fuel injector 73. It will be seen that the air inlet device 37 has an atmospheric inlet opening 112 which communicates with the atmosphere and is defined by a housing 113 in which a filter element 114 is positioned. Downstream of the filter element 114 there is the discharge to the throttle body 36 as well as a conduit 115 that communicates with the inlet port 109 of the air compressor 88. As a result, there is very little pressure drop for the air supplied to the air compressor 88 and it can operate at a good efficiency. The outlet port 111 is connected by a conduit 116 to a manifold that supplies the air/fuel injectors 48.

A suitable air pressure regulator to be described is provided for regulating the air pressure that is supplied from the air compressor 88 to the air/fuel injectors 48.

The fuel supply comprises a fuel tank 1117 that supplies fuel through a conduit 118 to a high pressure fuel pump 119. The fuel pump 119 outputs fuel under pressure through a conduit 121 to the fuel injectors 56 of the air/fuel injector assembly 48. A first pressure regulator 122 regulates the fuel pressure supplied to the fuel injector 56 so as to maintain a desired pressure difference between the fuel and air pressure supplied to the air/fuel injector 48. The excess fuel is by-passed through a line 123 which communicates with the auxiliary or sub-fuel injector 73 and in which a further pressure regulator 124 is positioned. The pressure regulator 124 sets the pressure of the fuel that is supplied to the auxiliary or sub-fuel injectors 73 and the excess fuel is returned to the tank 117 through a return conduit 125 in which a filter 126 is positioned.

A control line 127 extends from the air manifold to the pressure regulator 122 so as to regulate the air pressure supplied to the manifold. Excess air pressure is relieved by venting it to the atmosphere through a muffler 128.

The air pressure and fuel pressure signals from the pressure regulator 122 are supplied to a pressure sensing device 129 which outputs signals indicative of air and fuel pressure to a CPU 131. The CPU 131 also receives signals from other sensors to indicate both engine conditions and ambiant conditions and outputs control signals to the solenoid 71 of the air/fuel injector 48, the fuel injector 56 of air/fuel injector 48, the sub-fuel injector 73 and various other components of the engine to be controlled. The control strategy may be of any known type.

The drive for the air compressor 88 and water pump 87 and other accessories of the engine will now be described by particular reference to FIG. 1. It will be noted that there is a further drive pulley 133 affixed to the crankshaft 32 forwardly of the pulley 81 which drives the balancer shaft 75 (FIG. 3). This pulley 133 is engaged by a serpentine belt 134 which passes over an idler pulley 135 rotatably journalled on the front of the engine and which then engages the pulley 107 for driving the air compressor 88 and water pump 87.

The serpentine belt 135 also drives a further pulley 136 that is affixed to a drive shaft 137 of an alternator 138. The alternator 138 is positioned, in this embodiment, vertically above the air compressor 88 and forwardly of the water pump 87.

The belt 134 then passes back across the front of the engine 21 and engages an additional pulley 139 that is affixed to the drive shaft 141 of a further engine accessory such as a power steering pump 142.

The drive belt 134 then passes downwardly to engage a still further pulley 143 affixed to the drive shaft 144 of another engine accessory such as an air conditioned compressor 145 for driving it. The belt 134 then returns to the crankshaft pulley 133.

It should be readily apparent that the described constructions permits an extremely compact layout for the engine 21 and a very good drive for various accessories driven by the engine without overly complicating the structure and without making it difficult to service. In addition, a common air source is provided for both the induction air for the engine 21 and the air compressor which supplies to the fuel/air injector 48. Of course, the embodiment illustrated is only typical of one way in which the accessories may be positioned and FIGS. 8 through 12 show another embodiment of accessory drive and a somewhat different placement of the air compressor and water pump. In this embodiment, the induction system is also shown in more detail and that induction system will be described further and the description of the induction system also applies to the embodiment of FIGS. 1 through 7.

Because of the similarity of the embodiment of FIGS. 8 through 12 to the previously described embodiment, components which are the same have been identified by the same reference numerals and will be described again only insofar as is necessary to understand the construction and operation of this embodiment.

In this embodiment the engine is identified generally by the reference numeral 201 but, as has been noted, the construction is generally the same as the previously described embodiment. This embodiment also shows the transmission casing 202 that contains the flywheel 79 and the change speed transmission for driving the associated vehicle. Again, it will be noted that the balancer shaft 75 is positioned so that its rotational axis is disposed inwardly of the outer periphery of the flywheel 79 so as to provide a compact engine and low overall height.

In this embodiment, the water pump is not driven by the air compressor 88 and hence the air compressor 88 is positioned so that its cylinder block 98 extends vertically rather than horizontally and the crankshaft 103 of the air compressor 88 may be positioned forwardly of the manifold runners 39 to provide a somewhat lower mounting. That is, in this embodiment, the air compressor 88 is positioned out of the gap 86 formed by the intake manifold 40 and induction system 35 but still is quite low. In addition, the cylinder head 108 is positioned quite close to the air inlet device and also a relatively short length can be employed for the air supply to the air compressor 88 from the air cleaner. In this embodiment, the drive belt 134 is not a serpentine belt and only drives the air compressor 88 and alternator 138. The other accessories may be driven in any suitable manner.

Figure 9:
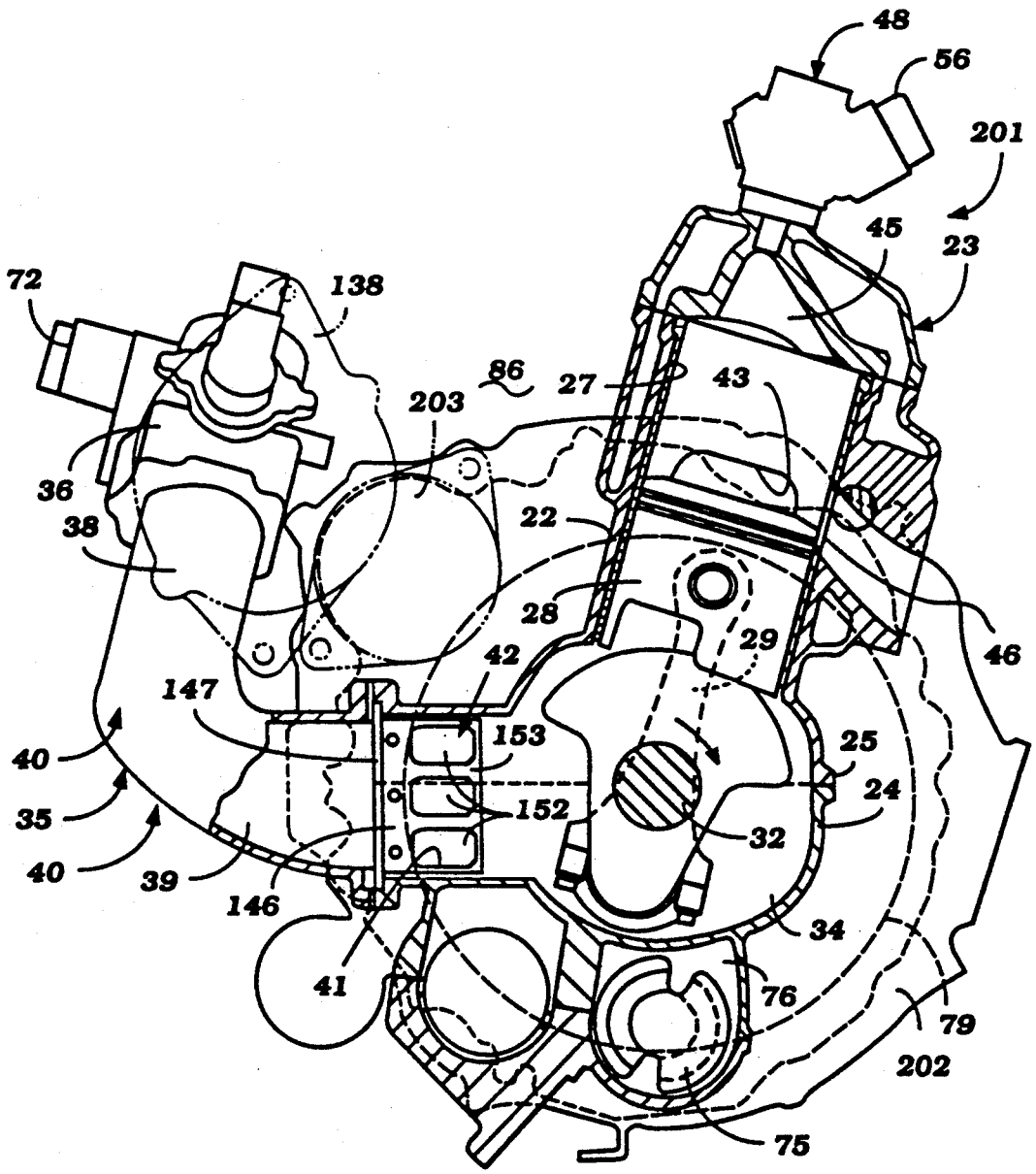
FIG. 9 is a cross sectional view, in part similar to FIG. 2, but showing the construction of this embodiment.
Figure 10:
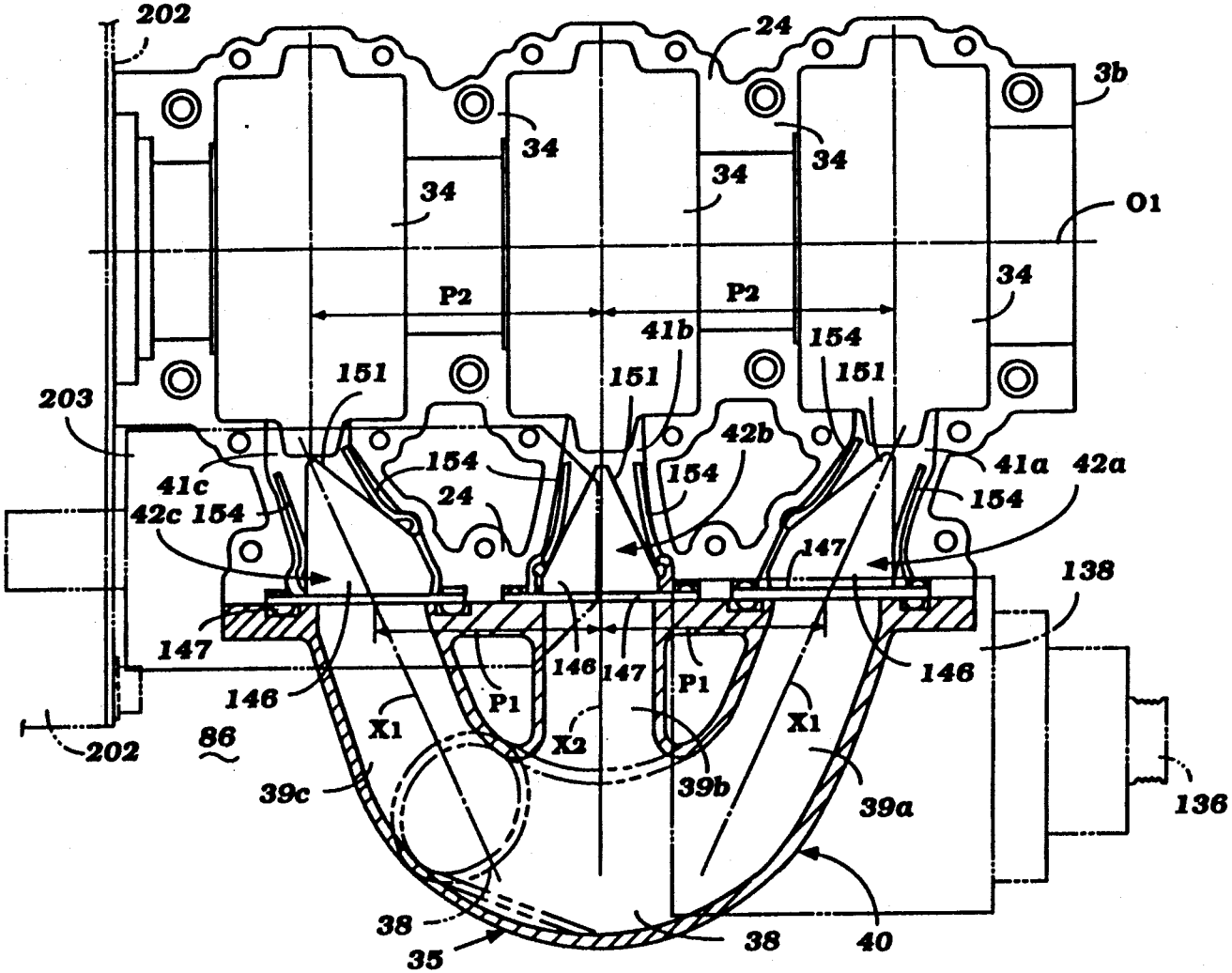
FIG. 10 is a cross sectional view taken through the crankcase chamber and lower portion of the induction system of this embodiment but it typical of that of the embodiment of FIGS. 1 through 7.
Figure 11:
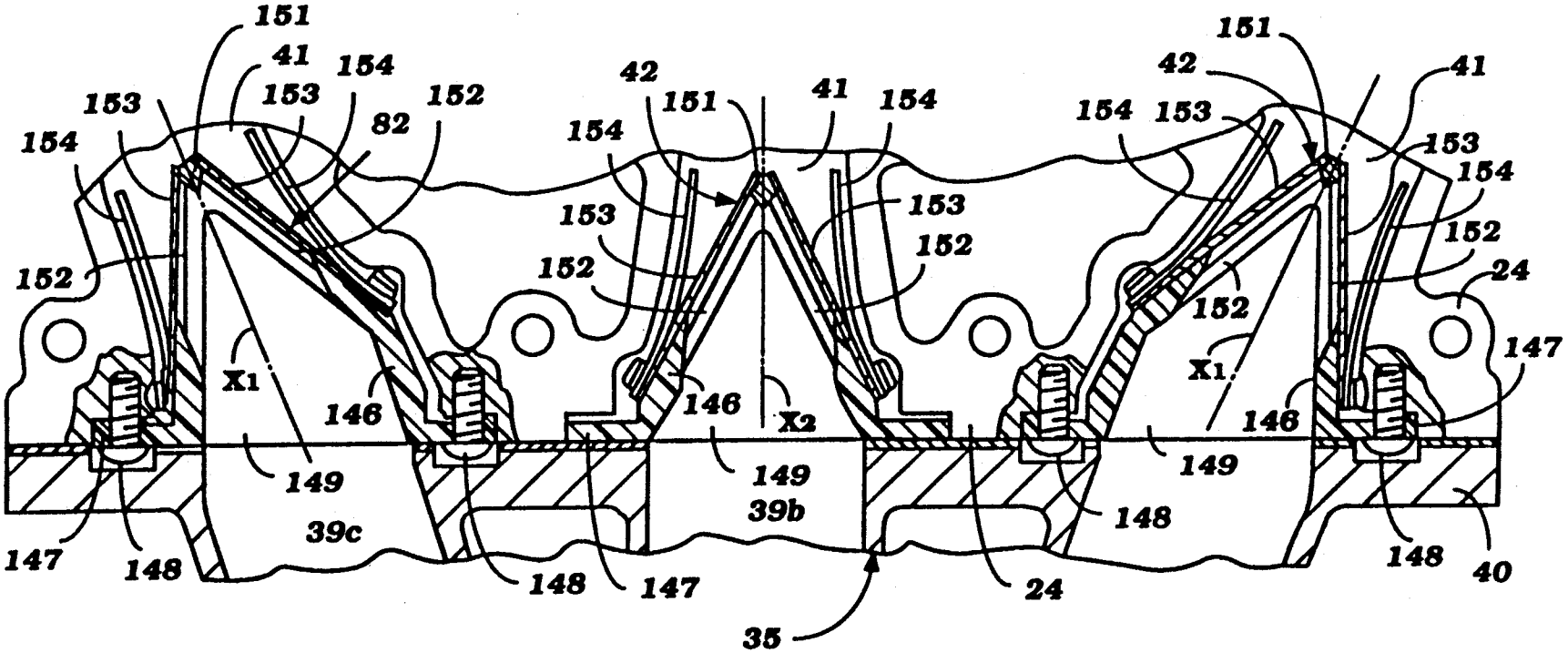
FIG. 11 is a further enlarged cross sectional view taken along the same plan as FIG. 10 and shows the further details of the relationship of the reed type check valves to the induction system.
Figure 12:
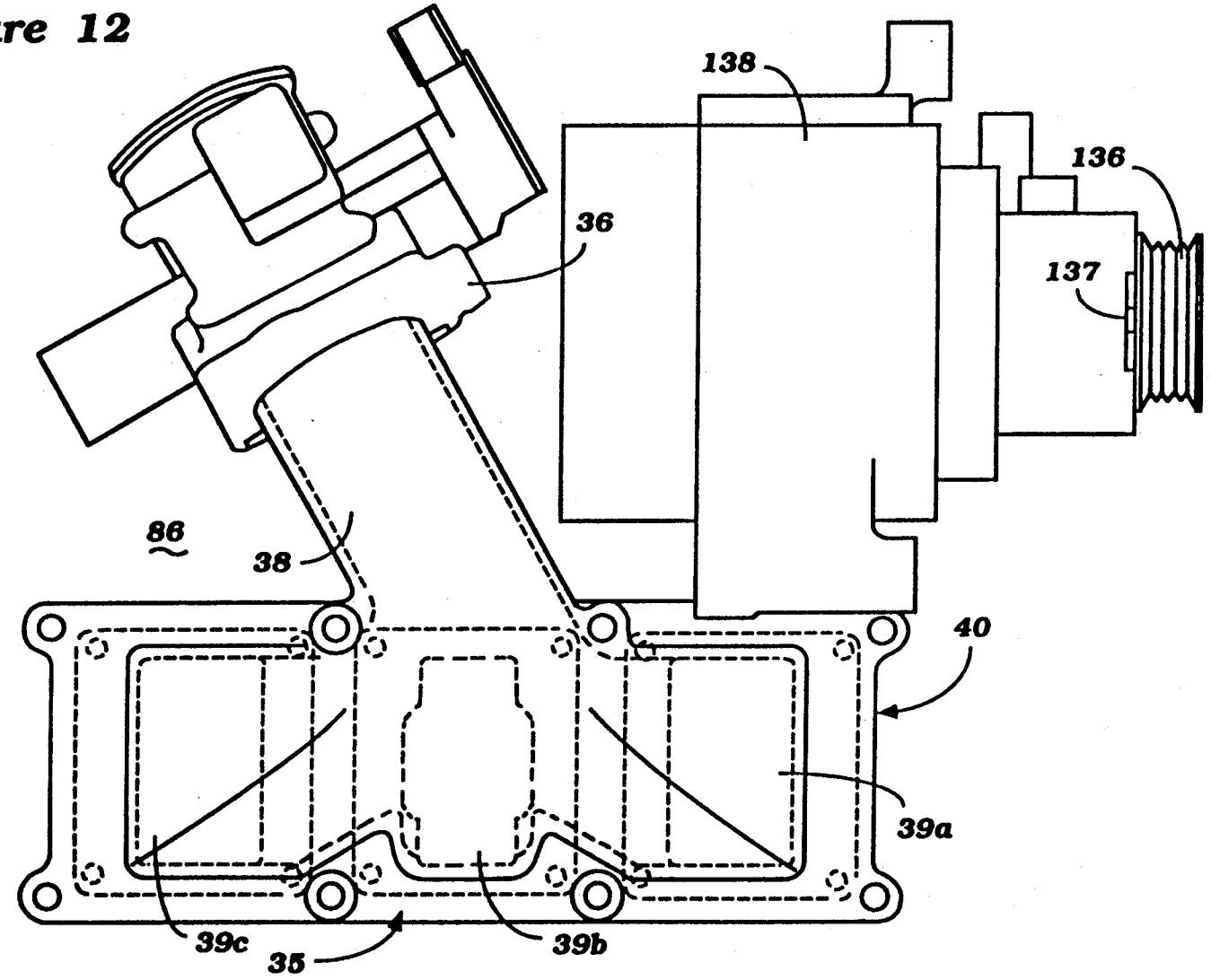
FIG. 12 is an enlarged view looking generally in the direction of the arrow 12 in FIG. 8 and shows the relationship of the intake manifold to certain of the auxiliary components driven by the engine.

As may be seen in FIGS. 9 and 10, in this embodiment a starter 203 for the engine is mounted in the recessed area 86 formed by the induction system 35 and thus the compact assembly of the previously described embodiment is also provided by this construction.

As has been previously noted, the drawings of this embodiment show the induction system 35 in greater detail and that induction system will now be described in further detail by particular reference to FIGS. 9 through 12. It should be understood that the following description also applies to the construction of the embodiment of FIGS. 1 through 7 and, for that reason, the main components have been identified by the same reference numerals.

It has been previously noted that the induction system 35 includes an intake manifold 40 having a common inlet opening 38 from which runners 39 emanate. In this embodiment, the runners for the individual cylinders have been identified by the reference numerals 39*a*, 39*b* and 39*c* progressing from front to rear of the engine. In a like manner, the cylinder block intake ports 41 have been identified by the reference numerals 41*a*, 41*b* and 41*c* embodying the same numbering pattern. Also, the check valves associated with each of the intake passages 41*a*, 41*b* and 41*c* have been identified by the reference numerals 42*a*, 42*b* and 42*c*. The construction of these check valves will be described in more detail by particular reference to FIGS. 10 and 11.

Each check valve has a valve cage 146 which has a flange portion 147 that is affixed to the side of the crankcase member 24 by means of threaded fasteners 148 that are concealed within recesses formed in the intake manifold and particularly the portion that forms the runners indicated respectively by the reference numerals 39*a*, 39*b* and 39*c*, adopting the same numbering pattern as applied to the other components of the induction system. Each valve cage 146 then defines a respective V-shape cavity 149 that is defined by a pair of intersecting walls that meet at an apex 151. It should be noted that the shapes of the respective valve cages 146 are different for each cylinder, for a reason which will be described.

These intersecting sides form air inlet openings 152 that are valved by reed type valve plates 153 which are affixed in a suitable manner to the caging members 146. Stopper plates 154 are also fixed to the caging members 146 by the same fasteners and limit the maximum degree of opening of the reed type valves 153 and thus reduce the stress on them.

It has been noted that the inlet portion 38 of the induction system is common and extends upwardly and rearwardly. This inlet portion 38 contacts the runners 39*a*, 39*b* and 39*c* at a common area formed adjacent the center runner 39*b*. It is desirable to insure that all of the runners have substantially the same length and to this end, the runners 39*a* and 39*c* have their central axes X1 disposed at acute angles to the axis X2 of the center runner 39*b*. These axes X1 and X2 intersect the respective apexes 151 of the valve cages 146. The angles X1 are equal to each other but in opposite senses and, accordingly, the distances P1 between the axes X1 and the axis X2 at the face of the crankcase member 25 are equal to each other. This is achieved by having the cages 146 of the check valves 42*a* and 42*c* disposed at the same angles as the angles X1 as clearly seen in the figures and specifically FIGS. 10 and 11. This insures equal length of the passages and therefore equal flow distribution to all cylinders.

It should be readily apparent that the described embodiments of the invention provide a very compact engine construction for a two cycle, crankcase compression engine embodying an air/fuel injector and afford ease of accommodation of the accessories driven by the engine and particularly the air compressor for the air/fuel injector. In addition, the construction permits a common air filter to be used for both the induction system and the air compressor of the air/fuel injector with minimum flow lengths and thus low flow resistances. Furthermore, the induction system is configured so as to accomplish this compact configuration and, at the same time, afford equal flow paths to each cylinder so that there will be balanced operation of the engine. Of course, the foregoing description is that of preferred embodiments of the invention and various changes and modifications may be made without departing from the spirit and scope of the invention, as described by the appended claims.

I claim:

1. A crankcase compression, two cycle, internal combustion engine comprising a crankcase forming at least one crankcase chamber, an intake manifold affixed to said crankcase and supplying a charge to said crankcase chamber, intake manifold having a substantially horizontally extending portion serving the crankcase, and an air compressor driven by said engine for supplying compressed air to said engine other than through said intake manifold and crankcase chamber, said air compressor being juxtaposed to said intake manifold.

2. A crankcase compression, two cycle, internal combustion engine as set forth in claim 1 wherein the air compressor is positioned above the substantially horizontally extending portion of the intake manifold.

3. A crankcase compression, two cycle, internal combustion engine as set forth in claim 2 wherein the air compressor is driven from the engine at one end of the engine.

4. A crankcase compression, two cycle, internal combustion engine as set forth in claim 3 wherein the air compressor is driven from one end of the crankshaft of the engine.

5. An induction system for a crankcase compression, internal combustion engine having a crankcase divided into at least two laterally spaced chambers, an intake manifold having a pair of angularly disposed runners extending from a common inlet to outlet each communicating with a respective one of said crankcase chambers through a respective outlet, and a respective check valve in each of said outlets for permitting flow into said crankcase chamber from said intake manifold and precluding flow from said crankcase chamber into said intake manifold, said check valves being disposed substantially parallel to the respective runners for maintaining equal length passages from said inlet opening to said outlets.

6. An induction system as set forth in claim 5 wherein the check valves comprise a caging member having a pair of angularly disposed sections having openings formed therein and meeting at a apex, said caging members being disposed in the parallel relationship to the respective runners.

7. An induction system as set forth in claim 5 wherein the crankcase further includes a third chamber spaced from the first and second chambers and wherein the intake manifold has a first runner extending perpendicularly to one of the chambers and second and third runners disposed on opposite sides of said first runner and at acute angles to said first runner.

8. An induction system as set forth in claim 7 wherein the outlet openings of the second and third runners are disposed at equal distances from the first runner.

9. An induction system as set forth in claim 8 wherein the check valves comprise a caging member having a pair of angularly disposed sections having openings formed therein and meeting at a apex, said caging members being disposed in the parallel relationship to the respective runners.

10. An internal combustion engine comprising an air induction system for supplying air to said engine for its combustion system, said induction system including an air filter element having an upstream side and a downstream side through which all air flowing to said engine must pass, an air compressor for supplying air to said engine for its operation, and means for supplying only a portion of the air flowing through said filter to said air compressor from said induction system downstream of said filter element.

11. An internal combustion engine as set forth in claim 10 wherein the air compressor is positioned so as to be protected by the induction system.

12. An internal combustion engine as set forth in claim 10 wherein the air compressor is a reciprocating compressor having a crankshaft and further including a further engine accessory driven by said crankshaft.

13. An internal combustion engine as set forth in claim 10 further including an air/fuel injector for injecting air and fuel to said engine, the air compressor supplying air to the air/fuel injector.

14. An internal combustion engine as set forth in claim 13 wherein the air compressor is positioned so as to be protected by the induction system.

15. An internal combustion engine as set forth in claim 14 wherein the air compressor is a reciprocating compressor having a crankshaft and further including a further engine accessory driven by said crankshaft.

16. A crankcase compression, two cycle, internal combustion engine comprising a crankcase forming at least one crankcase chamber, an intake manifold affixed to said crankcase and supplying a charge to said crankcase chamber, said intake manifold having a section spaced from said crankcase, chamber, and an air compressor driven by said engine for supplying compressed air to said engine other than through said intake manifold and crankcase chamber, said air compressor being juxtaposed to said intake manifold between said spaced section and said crankcase chamber.

17. A crankcase compression, two cycle, internal combustion engine as set forth in claim 16 wherein the air compressor is driven from the engine at one end of the engine.

18. A crankcase compression, two cycle, internal combustion engine as set forth in claim 17 wherein the air compressor is driven from said end of the crankshaft of the engine.

19. A crankcase compression, two cycle, internal combustion engine as set forth in claim 16 wherein the air compressor supplied compressed air to an air/fuel injector for the engine.

20. A crankcase compression, two cycle, internal combustion engine as set forth in claim 19 wherein the air compressor is driven from the engine at one end of the engine.

21. A crankcase compression, two cycle, internal combustion engine as set forth in claim 20 wherein the air compressor is driven from one end of the crankshaft of the engine.

22. A crankcase compression, two cycle, internal combustion engine as set forth in claim 21 wherein the air compressor is a reciprocating compressor having a crankshaft and wherein the crankshaft of said air compressor drives another engine accessory.

23. A crankcase compression, two cycle, internal combustion engine as set forth in claim 22 wherein the other engine accessory comprises a water pump.

24. A crankcase compression, two cycle, internal combustion engine as set forth in claim 1 wherein the intake manifold spaced section comprises a vertically extending section spaced transversely from the crankcase.

25. A crankcase compression, two cycle, internal combustion engine as set forth in claim 24 wherein the vertically extending section of the intake manifold serves a horizontally extending section that serves the crankcase.

26. A crankcase compression, two cycle, internal combustion engine as set forth in claim 25 wherein the air compressor is positioned above the horizontal extending section of the intake manifold.

27. A crankcase compression, two cycle, internal combustion engine as set forth in claim 26 wherein air is supplied to the air compressor for compression thereby from the intake manifold.

28. A crankcase compression, two cycle, internal combustion engine as set forth in claim 26 wherein the air compressor is driven from the engine at one end of the engine.

29. A crankcase compression, two cycle, internal combustion engine as set forth in claim 26 wherein the air compressor is driven from one end of the crankshaft of the engine.

30. A crankcase compression, two cycle, internal combustion engine comprising a crankcase chamber forming at least one crankcase chamber, an intake manifold affixed to said crankcase and supplying an air charge to said crankcase chamber, said engine further defining a combustion chamber and scavenge passage means for delivering a compressed charge from said crankcase chamber to said combustion chamber, an air/fuel injector for spraying fuel and air under pressure directly into said combustion chamber, a reciprocating air compressor having a crankshaft driven by said engine for supplying compressed air to said air/fuel injector, said air compressor being juxtaposed to said intake manifold, and another engine accessory driven by said air compressor crankshaft.

31. A crankcase compression, two cycle, internal combustion engine as set forth in claim 30 wherein the other engine accessory comprises a water pump.

32. A crankcase compression, two cycle internal combustion engine as set forth in claim 30 wherein the air compressor is driven from the engine at one end of the engine.

33. A crankcase compression, two cycle, internal combustion engine as set forth in claim 32 wherein the air compressor is driven from one end of the crankshaft of the engine.

34. A crankcase compression, two cycle, internal combustion engine as set forth in claim 30 wherein the intake manifold has a horizontally extending portion serving the crankcase.

35. A crankcase compression, two cycle, internal combustion engine as set forth in claim 34 wherein the air compressor is positioned above the horizontally extending portion of the intake manifold.

36. A crankcase compression, two cycle, internal combustion engine as set forth in claim 35 wherein the air compressor is driven from the engine at one end of the engine.

37. A crankcase compression, two cycle, internal combustion engine as set forth in claim 36 wherein the air compressor is driven from one end of the crankshaft of the engine.

38. A crankcase compression, two cycle, internal combustion engine as set forth in claim 30 wherein the intake manifold has a vertically extending section spaced transversely from the crankcase.

39. A crankcase compression, two cycle, internal combustion engine as set forth in claim 38 wherein the air compressor is positioned between the crankcase and the vertically extending section of the intake manifold.

40. A crankcase compression, two cycle, internal combustion engine as set forth in claim 39 wherein the vertically extending section of the intake manifold serves a horizontally extending section that serves the crankcase.

41. A crankcase compression, two cycle, internal combustion engine as set forth in claim 40 wherein the air compressor is positioned above the horizontally extending section of the intake manifold.

42. A crankcase compression, two cycle, internal combustion engine as set forth in claim 41 wherein the air compressor is driven from the engine at one end of the engine.

43. A crankcase compression, two cycle, internal combustion engine as set forth in claim 42 wherein the air compressor is driven from one end of the crankshaft of the engine.

44. A crankcase compression, two cycle, internal combustion engine as set forth in claim 41 wherein air is supplied to the air compressor for compression thereby from the intake manifold.

45. A crankcase compression, two cycle, internal combustion engine as set forth in claim 44 wherein the air compressor is driven from the engine at one end of the engine.

46. A crankcase compression, two cycle, internal combustion engine as set forth in claim 45 wherein the air compressor is driven from one end of the crankshaft of the engine.

* * * * *